US006761583B2

(12) United States Patent
Ortowski et al.

(10) Patent No.: US 6,761,583 B2
(45) Date of Patent: Jul. 13, 2004

(54) MODULAR SYSTEM INTERFACE APPARATUS

(75) Inventors: Mark Ortowski, Windsor, CO (US); Robert Millard, Loveland, CO (US)

(73) Assignee: Agilent Technologies, Inc., Palo Alto, CA (US)

( * ) Notice: Subject to any disclaimer, the term of this patent is extended or adjusted under 35 U.S.C. 154(b) by 0 days.

(21) Appl. No.: 09/871,837

(22) Filed: Jun. 1, 2001

(65) Prior Publication Data

US 2002/0182931 A1 Dec. 5, 2002

(51) Int. Cl.[7] ..... H01R 13/60
(52) U.S. Cl. ..... 439/540.1; 439/491; 439/570
(58) Field of Search ..... 439/540.1, 76.1, 439/564, 573, 562, 563, 565, 569, 570, 491

(56) References Cited

U.S. PATENT DOCUMENTS

| | | | | | |
|---|---|---|---|---|---|
| 3,711,817 | A | * | 1/1973 | Carter et al. | 339/121 |
| 3,950,058 | A | * | 4/1976 | Cronin | 339/75 |
| 4,353,614 | A | * | 10/1982 | Etchison, Jr. et al. | 339/125 |
| 4,572,602 | A | * | 2/1986 | Rupnik | 439/350 |
| 4,583,808 | A | * | 4/1986 | Porter et al. | 439/540.1 |
| 4,605,275 | A | * | 8/1986 | Pavel | 339/119 |
| 4,758,928 | A | * | 7/1988 | Wierec et al. | 361/415 |
| 4,895,535 | A | * | 1/1990 | Emadi et al. | 439/562 |
| 5,043,847 | A | * | 8/1991 | Deinhardt et al. | 361/395 |
| 5,492,478 | A | * | 2/1996 | White | 439/76.1 |
| 5,531,611 | A | * | 7/1996 | Reed et al. | 439/540.1 |
| 5,545,057 | A | * | 8/1996 | Tan et al. | 439/540.1 |
| 5,562,493 | A | * | 10/1996 | Ferrill et al. | 439/536 |
| 5,647,763 | A | * | 7/1997 | Arnold et al. | 439/540.1 |
| 5,658,166 | A | * | 8/1997 | Freeman et al. | 439/540.1 |
| 5,836,786 | A | * | 11/1998 | Pepe | 439/540.1 |
| 5,921,817 | A | * | 7/1999 | Niklos | 439/638 |
| 5,980,312 | A | * | 11/1999 | Chapman et al. | 361/788 |
| 6,077,113 | A | * | 6/2000 | Lecomte | 439/540.1 |
| 6,086,415 | A | * | 7/2000 | Sanchez et al. | 439/540.1 |
| 6,139,356 | A | * | 10/2000 | Daoud | 439/488 |
| 6,210,179 | B1 | * | 4/2001 | Lausberg et al. | 439/76.1 |
| 6,229,709 | B1 | * | 5/2001 | Hardt et al. | 361/753 |
| 6,273,752 | B1 | * | 8/2001 | Martin et al. | 439/540.1 |
| 6,302,742 | B1 | * | 10/2001 | Berst et al. | 439/638 |

FOREIGN PATENT DOCUMENTS

| | | |
|---|---|---|
| CN | ROC420327 | 2/1988 |
| CN | ROC256417 | 9/1995 |

* cited by examiner

*Primary Examiner*—P. Austin Bradley
*Assistant Examiner*—Edwin A. Leon

(57) ABSTRACT

A modular system interface is provided. The apparatus includes a main panel that is configured to be attached to a rack and includes a plurality of cut-outs. A plurality of sub-panels are configured to be attachable to the main panel, spanning across the respective cut-out. Each sub-panel supports one predetermined type of connector. The present invention can also be viewed as a method for providing a modular system interface. In this regard, the method can be broadly summarized by the steps of providing a main panel configured to be attachable to a rack and including a plurality of cut-outs. The method includes providing a plurality of sub-panels configured to be attachable to the main panel across a respective the cut-out, wherein each sub-panel supports a predetermined type of connector.

10 Claims, 6 Drawing Sheets

MODULAR SYSTEM INTERFACE APPARATUS

TECHNICAL FIELD

The present invention is generally related to test system equipment, and more particularly, to a test system modular system interface.

BACKGROUND OF THE INVENTION

Currently, there are several off-the-shelf mass interconnect systems that are available for use with test systems. Such interconnect systems typically allow multiple signal conduits of varying types to be connected at the same time with a single actuation. Consequently, they allow for quick change-over from one fixture to another and customization between particular applications. However, the mass interconnectors currently available are generally too expensive for the low-cost test systems used with high volume manufacturing processes. These low-cost systems usually resort to a system interface that consists of a single panel punched with holes for each connector needed. Such interfaces lack flexibility in terms of redefining and labeling future system resources. It is also difficult to separate the interface from the test system for diagnostics, reconfiguration, repair or maintenance. Moreover, a number of equipment manufacturers including, but not limited to, cell phones manufacturers, need to be able to reuse their test systems for multiple equipment models and test stages in order to keep asset utilization high. Test systems, because of equipment model changes, often need to be reconfigured or upgraded to increase the test system utilization.

Thus, a heretofore unaddressed need exists in the industry to address the aforementioned deficiencies and inadequacies.

SUMMARY OF THE INVENTION

The present invention provides an apparatus and method for providing a modular system interface. The apparatus utilizes a main panel that is configured to be attachable to a rack and includes at least one sub-panel slot. At least one sub-panel is configured to be attachable to the main panel through the sub-panel slot, and the at least one sub-panel supports a predetermined connector.

Briefly described, in architecture, one embodiment of the system, among others, can be implemented as follows. The apparatus utilizes a main panel that is configured to be attachable to a rack and includes at least one sub-panel slot. At least one sub-panel is configured to be attachable to the main panel through the sub-panel slot, and the at least one sub-panel supports a predetermined connector.

The present invention can also be viewed as providing methods for providing a method for a modular system interface. In this regard, one embodiment of such a method, among others, can be broadly summarized by the following steps: (1) providing a main panel configured to be attachable to a rack and including at least one sub-panel slot, and (2) providing at least one sub-panel configured to be attachable to the main panel in the sub-panel slot, wherein the at least one sub-panel supports a predetermined connector.

Other systems, methods, features, and advantages of the present invention will be or become apparent to one with skill in the art upon examination of the following drawings and detailed description. It is intended that all such additional systems, methods, features, and advantages be included within this description, be within the scope of the present invention, and be protected by the accompanying claims.

BRIEF DESCRIPTION OF THE DRAWINGS

The invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION OF THE PREFERRED EMBODIMENT

Figure 1:
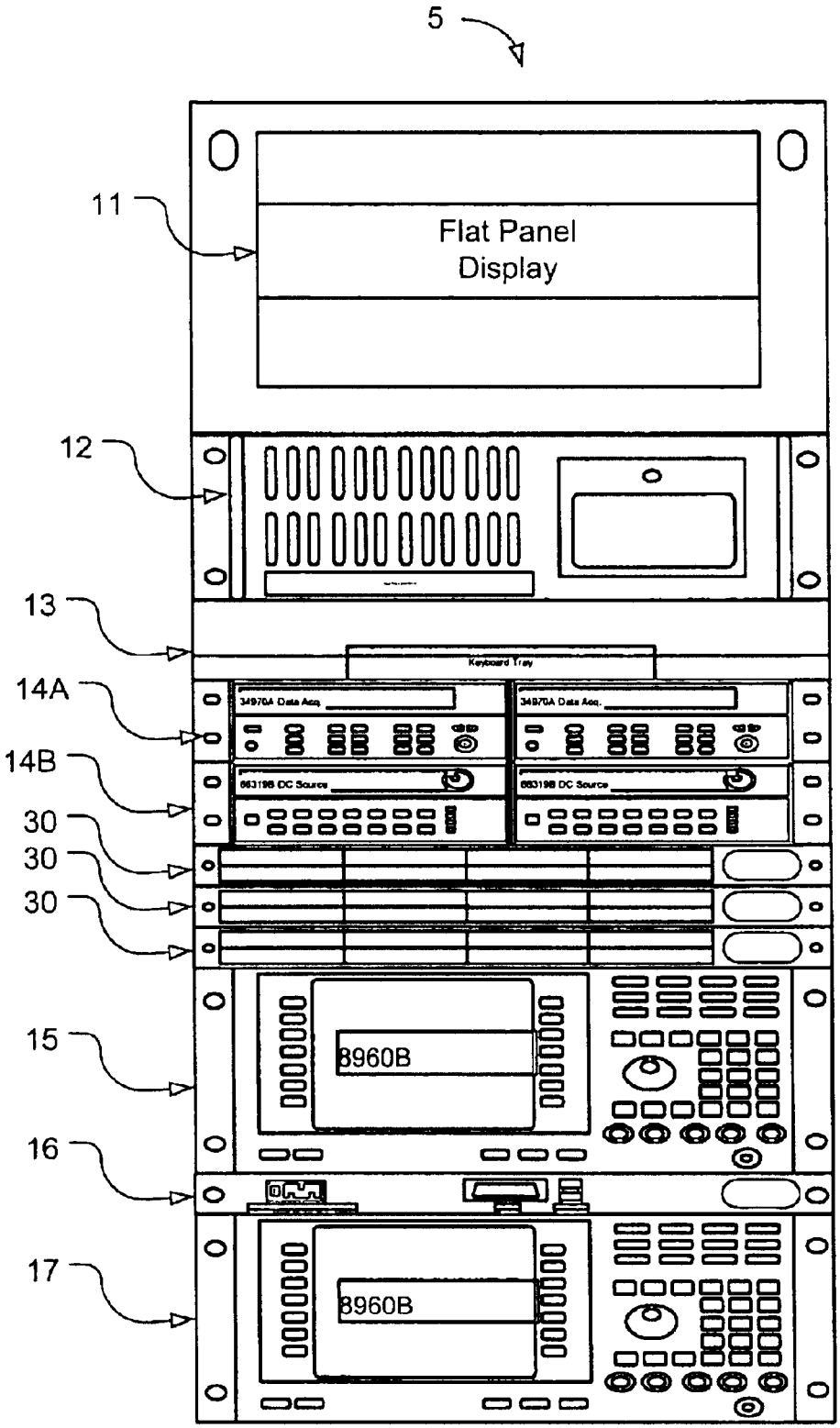
FIG. 1 is a front view of a rack-type test system utilizing the system interface panel of the present invention.

The system interfaces are typically used to interface a test system with a large variety of testable equipment. Primarily, the system interface allows multiple fixtures to be attached to the test system so that numerous different devices can be tested utilizing the same test system. A system interface also allows a system to be easily separated from the fixture in order to perform diagnostics, repair or maintenance.

In particular, cell phone manufacturers have a need to be able to reuse equipment for multiple different phone types in numerous test stages in order to fully utilize the test system. Test systems often need to be reconfigured or upgraded in order to enable a testing technician to perform testing on a variety of devices. The system interface of the present invention facilitates this need by providing a flexible system interface that can be quickly and cost-effectively changed as needed. In addition, the modular system interface of the present invention consumes a minimal amount of rack space on a test system rack. The system interface of the present invention has flexibility to allow interfacing to a large variety of devices and allows the test system to be changed whenever the testing requirements change. This allows customers to more easily reuse the test system in various stages of a manufacturing process or to increase the test system's capabilities.

In the preferred embodiment, the modular system interface of the present invention utilizes common D-sub style connectors, which are readily available around the world and are inexpensive. However, it is contemplated by the inventors that any number of other connectors could be utilized. For purposes of illustration, the following disclosure will discuss the applicability of D-sub style connectors, however, it is understood that different types of connectors could be utilized.

The modular system interface of the present invention provides for the ability to replace worn-out connectors as needed. Serviceability is improved in that the connectors can be replaced by only removing the minimum amount of hardware. In the examples discussed in this disclosure, the utilization of D-sub style connectors enables the placement of connectors by removing only two screws. Labeling of these connectors can also be accomplished using adhesive Mylar or polycarbonate labels attached to the subpanels, which are more durable than any prior art type of labeling systems.

The modular system interface of the present invention consists of a main panel and a variety of sub-panels made of sheet metal. However, it is contemplated by the inventors that other types of material such as fiberglass, plastic, or glass can be utilized. The main panel mounts in a standard 19-inch rack and is preferably a single rack-unit tall. In the preferred embodiment, the main panel contains up to eight locations for mounting smaller sub-panel assemblies in a space that is a single rack-unit tall. It is contemplated by the inventor that there can be any number of subpanel locations depending on the rack size and the size of the sub-panels.

Each sub-panel contains a cutout used to mount a connector for access to a particular system resource or instrument. The sub-panels are then attached to the main panel using two screws that mate with captive nuts in the main panel. It is also contemplated by the inventors that numerous other types of attaching means can be utilized, such as clips, snaps, ¼-turn fasteners, and the like.

Each connector can be labeled with a durable, adhesive, Mylar-type label that is affixed to the sub-panel. Having labels that are separate from the subpanel allows more system flexibility than painting and silk-screening the sub-panel. Larger, double-wide sub-panels can be used for mounting larger connectors that will not fit into a single sub-panel. It is also possible to use the double-wide sub-panels to contain predetermined groups of connectors. Sub-panels can also be utilized to cover unused sub-panel locations on the main panel. A detailed explanation of the modular system interface of the present invention and sub-panels will herein be described with regard to FIGS. 2–10.

Illustrated in FIG. 1 is an example of a test system utilizing the modular system interface of the present invention. Typically, rack-test systems follow the E.I.A. (Electronic Industries Association or EIA) "19 inch" rules in order to provide a structure that can accept standard-size test equipment, such as oscilloscopes, display panels, keyboard trays, data storage, and the like. The rack structure provides an entire structure that is strong and sturdy that provides for quick and easy connection of multiple type of electronic devices for operation in the rack. The racks complying with the international EIA 19-inch standard utilize a universal system for indicating the number of units that can fit into the racks, such as, but not limited to, 4U, 6U, 10U and up. Vertical space within the rack is measured in modular units, where one rack unit is 1.75 in high. The total width of the main panel 31 is 19 inches and the hole-to-hole spacing of the main panel is 18.3 as defined by the EIA standard. These racks contain a variety of test equipment and interconnects normally requiring cable interfaces to enable a user to connect to equipment in the rack.

One problem with this configuration is that the number of cables, connection panels and equipment used in the rack can limit the ability of the test system to work with other hardware, thus affecting the system's capacity, upgrade ability, cost and usability. However, utilizing a standardized test system based on an EIA 19-inch rack can consume too much space to connect a wide variety of devices to the test system. Thus, with the limited amount of rack space, these interconnects can consume a disproportionate amount of limited space.

The modular system interface of the present invention solves this problem by providing for a modular system that allows for the flexibility to utilize a large number of connector interfaces that can be reconfigured in a short amount of time. In the preferred embodiment, the modular system interface of the present invention only consumes two rack units of vertical space, thus reducing the amount of space available for other test equipment. Doing this provides for the ability to provide modularity, to add or delete system components or interfaces, and to use common or low-cost connectors that are readily available anywhere in the world.

Figure 2:
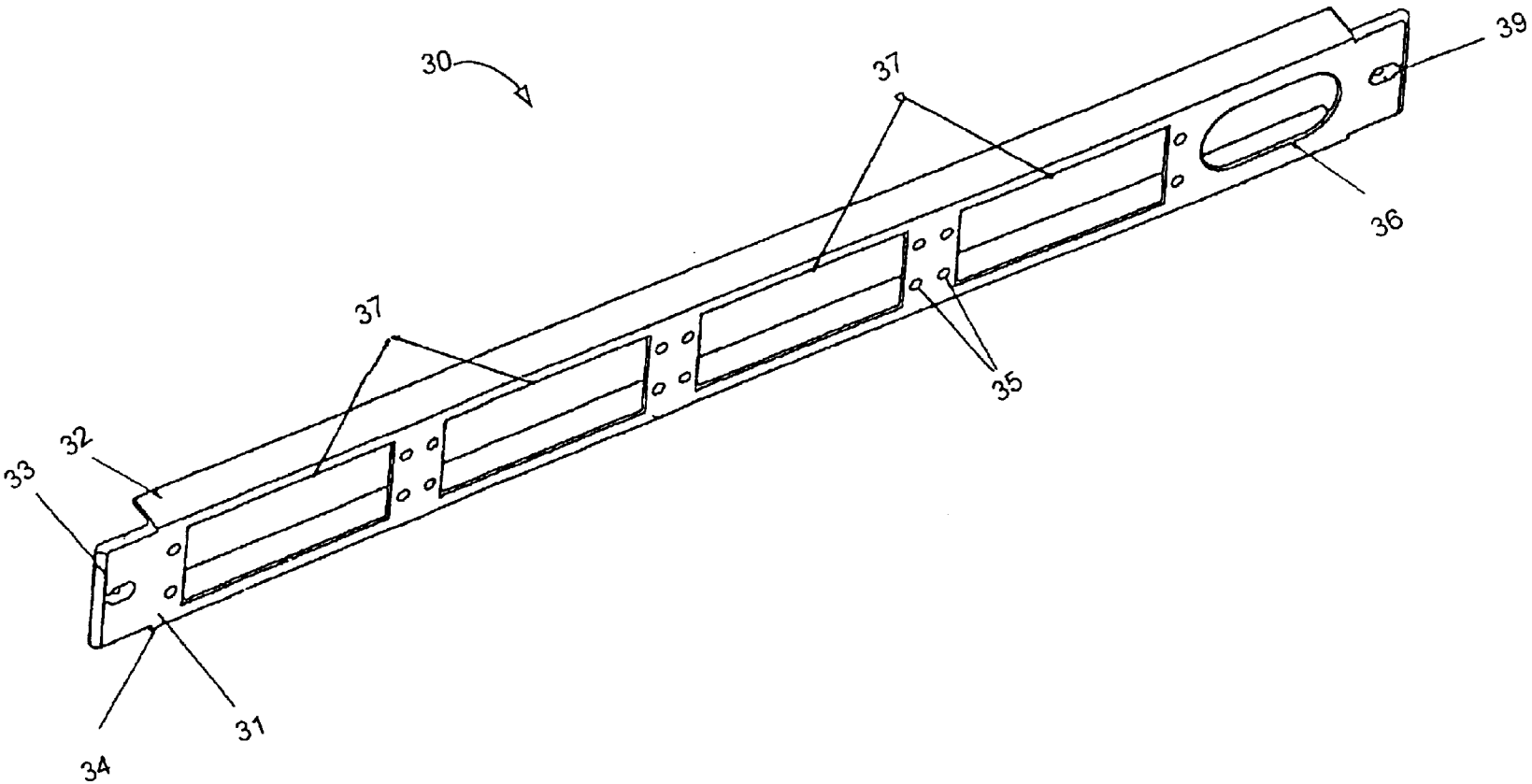
FIG. 2 is a perspective view of one example of the modular system interface of the present invention, as shown in FIG. 1.

Illustrated in FIG. 2 is a perspective view of an example of a main panel 31 of the modular system interface 30 of the present invention. The modular system interface 30 of the present invention comprises a number of bolt-in sub-panels that will allow almost any type of connector to be mounted in the main panel 31 for access to standard and custom fixture resources. The sub-panels will allow for resource expansion if input/output requirements change. Unused cut-out 37 spaces can be covered utilizing a filler sub-panel. A feed-through hole 36 is also present in the main panel 31 to provide for easy pass-through of cables that cannot utilize a standardized connector in the sub-panel assembly.

As shown, the modular system interface panel 30 has a main panel 31 that includes top lip 32, side lip 33 and bottom lip 34 for support. Also contained with the main panel 31 of the modular system interface 30, are cutouts 37 to allow for sub-panel attachment. Receptacles 35 are threaded material that can be threaded within the main panel 31 or thread structures attached to main panel 31, or other type of attachment means. The main panel 31 includes attachment means 39 to attach the modular system interface to the standard E.I.A. 19-inch rack.

Figure 3:
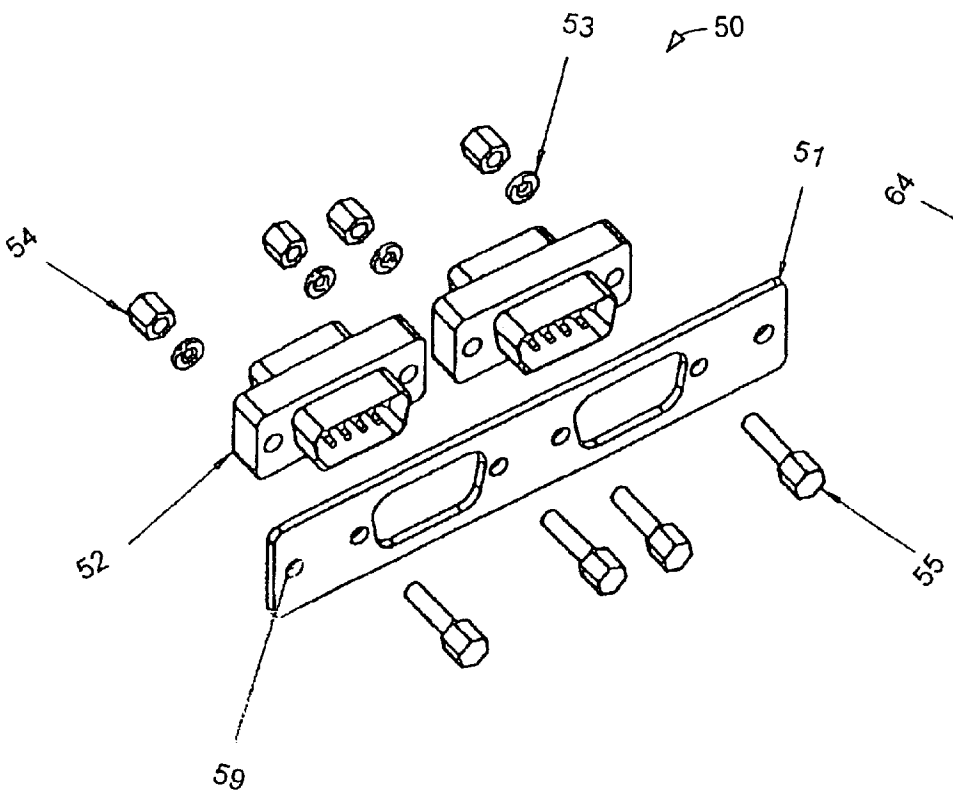
FIG. 3 is a perspective view of one example of a dual DB9 connector sub-panel assembly that can be utilized with the system interface of the present invention, as shown in FIGS. 1 and 2.

Illustrated in FIG. 3 is a perspective view of an example of a dual DB9 connector sub-panel assembly 50. The dual DB9 connector sub-panel assembly 50 consists of a dual DB9 sub-panel 51 that includes a cut-out for the two DB9 connectors 52. Illustrated is a male connector, however, it is contemplated by the inventors that any type of DB9 connector, male or female, may be used. In order to attach the DB9 connector 52 to the dual DB9 sub-panel 51, a locking or anti-rotation washer 53, hexnut 54 and jack screw 55 are utilized. The screw 55 is inserted into the dual DB9 sub-panel 51 through a support hole in the DB9 connector 52 to enable the washer 53 and hexout 54 to be fastened to the screw 55. The dual DB9 sub-panel assembly 50 is then connected to the main panel 31 of the modular system interface 30 of the present invention, utilizing the attaching means 59. The attaching means 59 may be a hole for a screw, snap-clip or other type of attaching means to enable the dual DB9 sub-panel assembly 50 to be attached to the main panel 31 of the modular system interface 30.

Figure 4:
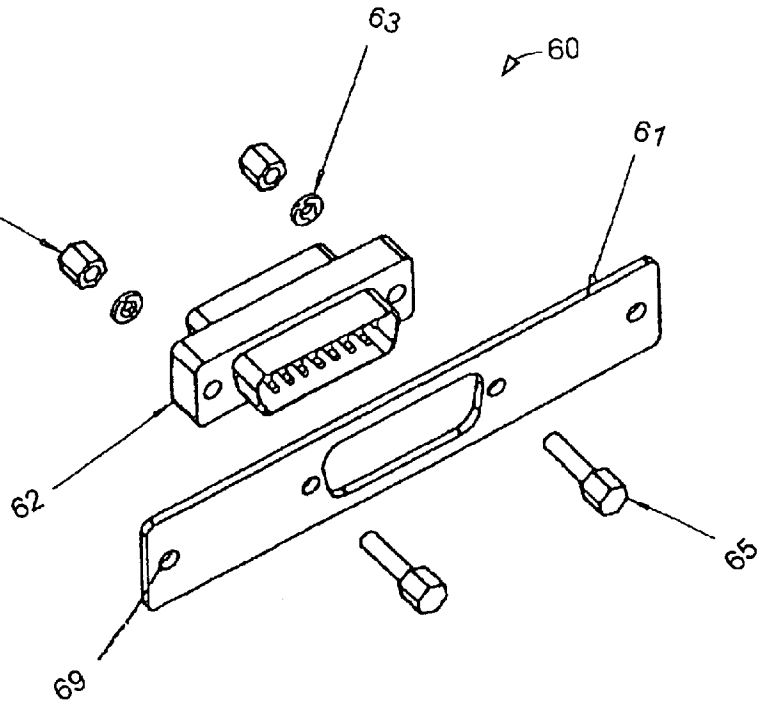
FIG. 4 is a perspective view of one example of a DB15 connector sub-panel assembly that can be utilized by the system interface of the present invention, as shown in FIGS. 1 and 2.

Illustrated in FIG. 4 is a perspective view of an example of a DB15 sub-panel assembly 60 to be utilized with the modular system interface 30 of the present invention. The DB15 sub-panel assembly 60 is comprised of a DB15 sub-panel 61 that has a cut-through for a DB15 connector 62. The DB15 connector 62 is attached to the DB15 sub-panel 61 utilizing washer 63, hexnut 64 and screw 65. The DB15 sub-panel assembly 60 is then connected to the main panel 31 of the modular system interface 30 of the present invention, utilizing the attaching means 69. The attaching means 69 may be a hole for a screw, snap-clip or other type of attaching means to enable the DB15 sub-panel assembly 60 to be attached to the main panel 31 of the modular system interface 30.

Figure 5:
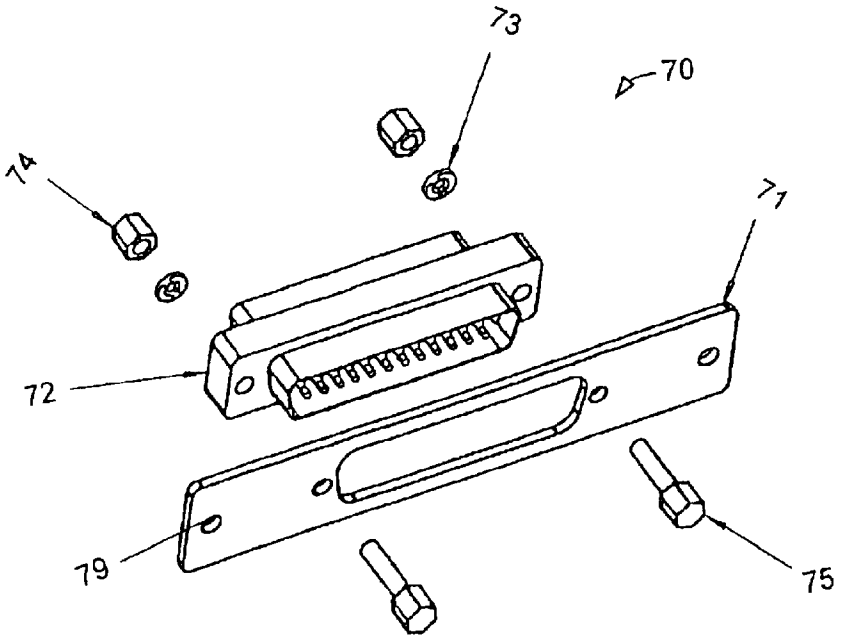
FIG. 5 is a perspective view of one example of a DB25 connector sub-panel assembly that can be utilized with the system interface, as shown in FIGS. 1 and 2.

Illustrated in FIG. 5 is a perspective view of an example of a DB25 sub-panel assembly 70 to be utilized with the modular system interface 30 of the present invention. The DB25, sub-panel assembly 70 is comprised of a DB25 sub-panel 71 that has a cut-through for a DB25 connector 72. The DB25 connector 72 is attached to the DB25 sub-panel 71 utilizing washer 73, hexnut 74 and screw 75. The DB25 sub-panel assembly 70 is then connected to the main panel 31 of the modular system interface 30 of the present invention, utilizing the attaching means 79. The attaching means 79 may be a hole for a screw, snap-clip or other type of attaching means to enable the DB25 sub-panel assembly 70 to be attached to the main panel 31 of the modular system interface 30.

Figure 6:
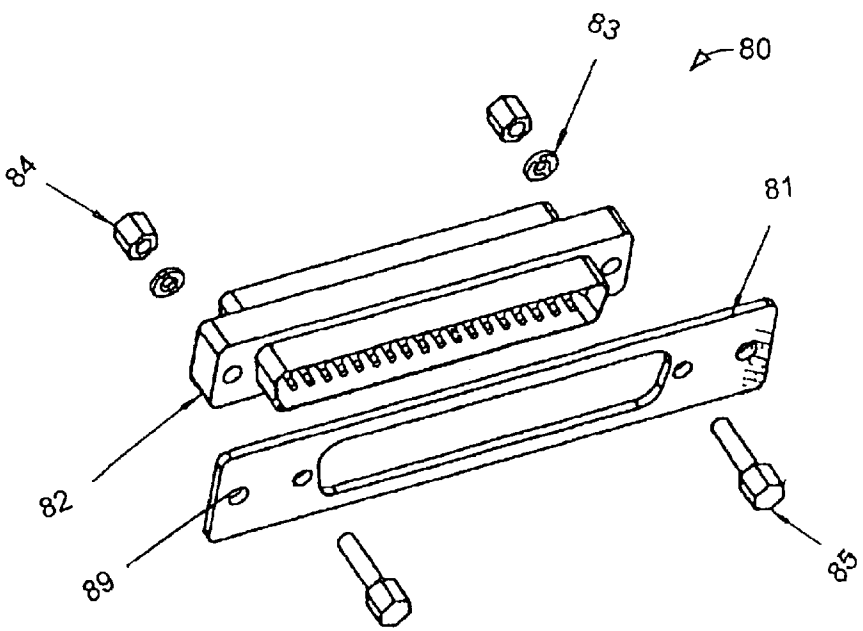
FIG. 6 is a perspective view of one example of DB37 connector sub-panel assembly that can be utilized in connection with the system interface of the present, as shown in FIGS. 1 and 2.

Illustrated in FIG. 6 is a perspective view of an example of a DB37 sub-panel assembly 80 to be utilized with the modular system interface 30 of the present invention. The DB37, sub-panel assembly 80 is comprised of a DB37 sub-panel 81 that has a cut-through for a DB37 connector 82. The DB37 connector 82 is attached to the DB37 sub-panel 81 utilizing washer 83, hexnut 84 and screw 85. The DB37 sub-panel assembly 80 is then connected to the main panel 31 of the modular system interface 30 of the present invention, utilizing the attaching means 89. The attaching means 89 may be a hole for a screw, snap-clip or other type of attaching means to enable the DB37 sub-panel assembly 80 to be attached to the main panel 31 of the modular system interface 30.

Figure 7:
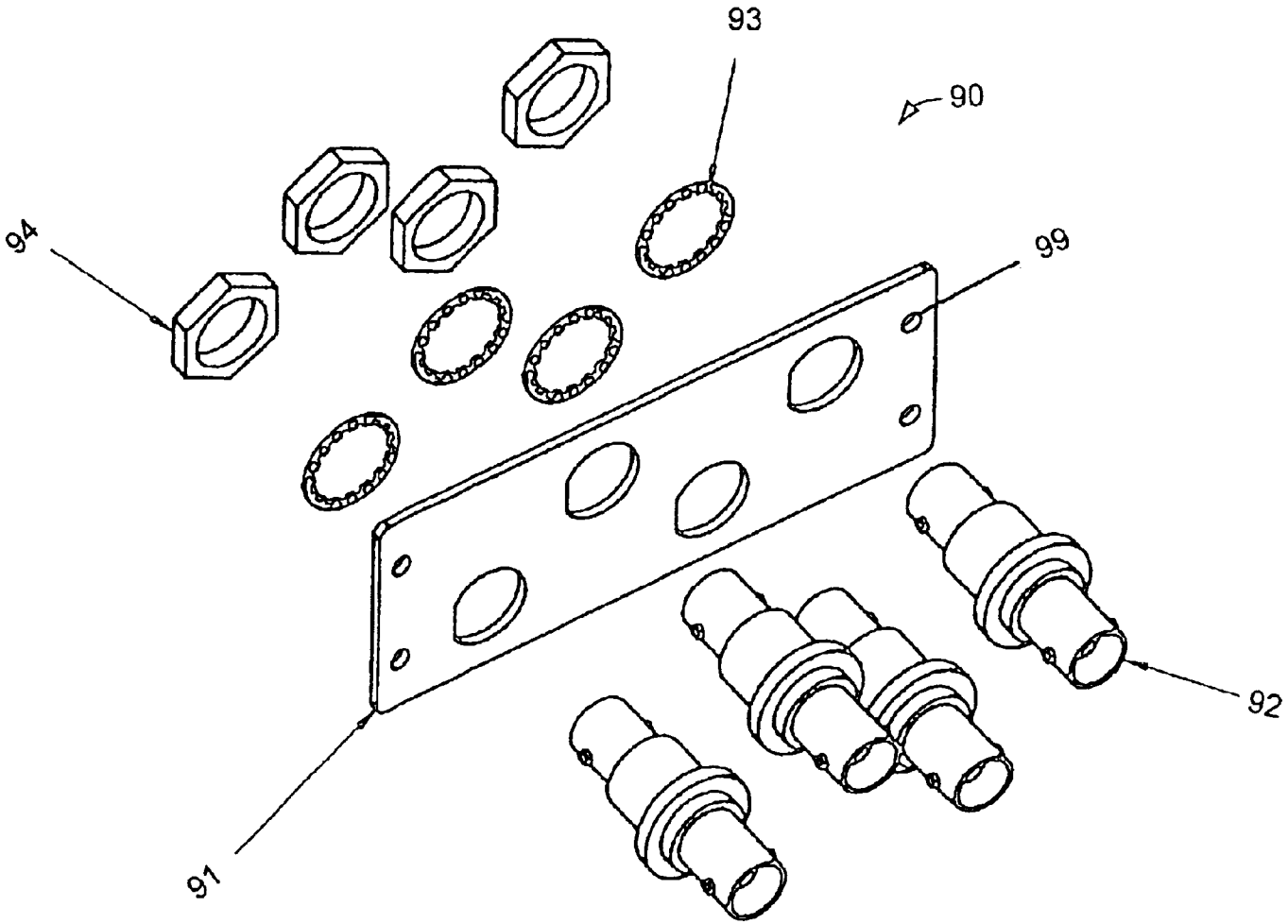
FIG. 7 is a perspective view of one example of a double-height connector sub-panel assembly that can be utilized with the system interface of the present invention, as shown in FIGS. 1 and 2.

Illustrated in FIG. 7 is a perspective view of an example of a 4 BNC sub-panel assembly 90. The example of the 4 BNC sub-panel assembly 90 includes a 4 BNC sub-panel 91 with four cut-outs for accepting a BNC connector 92. The BNC connector 92 is attached to the 4 BNC sub-panel 91 utilizing washers 93 and hexnuts 94. The 4 BNC sub-panel assembly 90 is connected to the main panel 31 of the modular system interface 30 and utilizes two vertically adjacent sub-panel cutouts 37 (FIG. 2) on the main panel 31 of the modular system interface 30. The 4 BNC sub-panel assembly 90 is then connected to the main panel 31 of the modular system interface 30 of the present invention, utilizing the attaching means 99. The attaching means 99 may be a hole for a screw, snap-clip or other type of attaching means to enable the 4 BNC sub-panel assembly 90 to be attached to the main panel 31 of the modular system interface 30.

Figure 9:
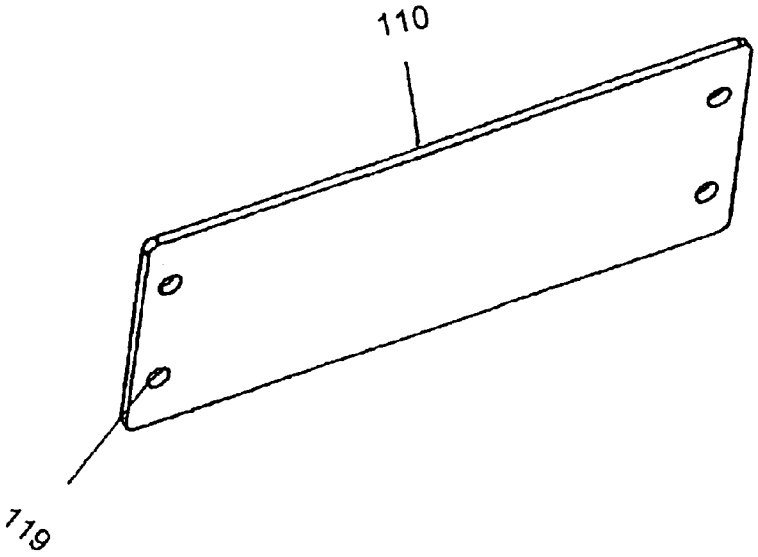
FIG. 9 is a perspective view of one example of a dual filler panel that can be utilized with the system interface of the present invention, as shown in FIGS. 1 and 2.
Figure 8:
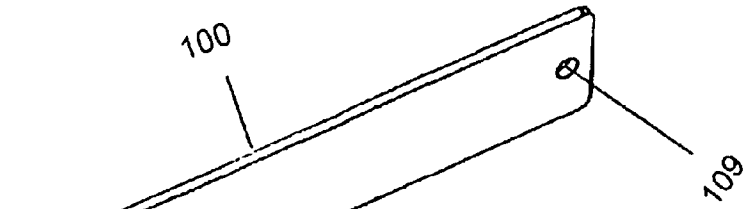
FIG. 8 is a perspective view of one example of a single filler panel that can be utilized with the system interface of the present invention, as shown in FIGS. 1 and 2.

Illustrated in FIGS. 8 and 9 are a perspective view of an example of a single sub-panel filler 100 and dual filler sub-panel 110. These filler sub-panels 100 and 110 enable a user to cover unused sub-panel cutouts 37 on the main panel 31 of the modular system interface 30. The single sub-panel filler 100 and dual filler sub-panel 110 are then connected to the main panel 31 of the modular system interface 30 of the present invention, utilizing the attaching means 109 and 119. The attaching means 109 and 119 may be a hole for a screw, snap-clip or other type of attaching means to enable the filler sub-panels 100 and 110 to be attached to the main panel 31 of the modular system interface 30.

It should be understood by those of ordinary skill in the art that dual sub-panels can be comprised of any combination of connector types, such as, but not limited to, a 4 DB9 connector sub-panel, a DB9 and DB15 connector combination, and the like. The inventors contemplate that any number of combinations can be utilized by the modular system interface 30.

It should be emphasized that the above-described embodiments of the present invention, particularly, any "preferred" embodiments, are merely possible examples of implementations, merely set forth for a clear understanding of the principles of the invention. Many variations and modifications may be made to the above-described embodiment(s) of the invention without departing substantially from the spirit and principles of the invention. All such modifications and variations are intended to be included herein within the scope of this disclosure and the present invention and protected by the following claims.

What is claimed is:

1. A modular system interface comprising:

a main panel configured to be attachable to a rack, the main panel including a plurality of sub-panel cut-outs, each sub-panel cut-out having two sub-panel slots, the main panel further including a pair of attachment elements located adjacent to each of the sub-panel slots, the attachment elements of each pair positioned on opposite sides of the respective sub-panel slot;

a plurality of sub-panels configured to be attachable to the main panel, at least one sub-panel including at least one connector cut-out, wherein each sub-panel spans across a respective sub-panel slot and individually attaches to a respective pair of attachment elements;

a plurality of electrical connectors configured to be insertable in the at least one electrical connector cut-out and attachable to the respective sub-panel, wherein the at least one sub-panel is configured to support one predetermined type of electrical connector.

2. The modular system interface of claim 1, wherein the main panel further comprises:

a feed-through hole having sufficient dimensions to allow pass-through of a cable.

3. The modular system interface of claim 1, wherein the main panel further comprises:

a bottom support that provides support for the main panel on the rack.

4. The modular system interface of claim 1, wherein the main panel further comprises:

a top support that provides support for the main panel on the rack.

5. The modular system interface of claim 1, wherein the main panel is stamped from sheet metal.

6. The modular system interface of claim 1, wherein the attachment elements comprise a threaded structure.

7. The modular system interface of claim 1, wherein each sub-panel further comprises:

means for attaching to the main panel.

8. The modular system interface of claim 1, wherein at least on sub-panel spans across both sub-panel slots of a respective sub-panel cut-out and is attachable to the two respective pairs of attachment elements.

9. The modular system interface of claim 1, wherein each sub-panel further comprises:

a label marking area to identify the respective predetermined type of connector.

10. The modular system interface of claim 9, wherein an adhesive mylar label is attached to the label marking area.

* * * * *